US007434790B1

(12) United States Patent
Hansen

(10) Patent No.: US 7,434,790 B1
(45) Date of Patent: Oct. 14, 2008

(54) VERTICAL PANEL GLASS WALL

(76) Inventor: Tracy C. Hansen, 4860 NW. Shute Rd., Hillsboro, OR (US) 97124

( * ) Notice: Subject to any disclaimer, the term of this patent is extended or adjusted under 35 U.S.C. 154(b) by 163 days.

(21) Appl. No.: 11/435,967

(22) Filed: May 17, 2006

(51) Int. Cl.
*E04H 17/16* (2006.01)

(52) U.S. Cl. ..... 256/24; 52/239; 52/241; 52/242; 52/780; 52/235; 256/59; 256/19

(58) Field of Classification Search ..... 52/239, 52/241, 242, 780, 204.597, 235, 764, 770; 256/24, 59, 19
See application file for complete search history.

(56) References Cited

U.S. PATENT DOCUMENTS

| | | | | | |
|---|---|---|---|---|---|
| 2,141,000 | A * | 12/1938 | Hohl | 52/308 |
| 3,593,963 | A * | 7/1971 | Horgan, Jr. | 256/24 |
| 4,155,540 | A * | 5/1979 | Horgan, Jr. | 256/23 |
| 4,390,165 | A * | 6/1983 | Murdock | 256/24 |
| 4,690,383 | A * | 9/1987 | Batcheller | 256/24 |
| 4,883,267 | A * | 11/1989 | Burley | 472/90 |
| 4,905,970 | A * | 3/1990 | Holmsten et al. | 256/24 |
| 5,152,113 | A * | 10/1992 | Guddas | 52/238.1 |
| 5,200,240 | A * | 4/1993 | Baker | 428/34.1 |
| 5,207,037 | A * | 5/1993 | Giles et al. | 52/126.6 |
| 5,309,689 | A * | 5/1994 | Croissant | 52/235 |
| 5,480,126 | A * | 1/1996 | Teasdale | 256/19 |
| 5,556,080 | A * | 9/1996 | Vise | 256/24 |
| 6,106,401 | A * | 8/2000 | McAlpine | 472/92 |
| 6,158,182 | A * | 12/2000 | Biebuyck | 52/235 |
| 6,205,724 | B1 * | 3/2001 | Garling et al. | 52/209 |
| 6,349,517 | B1 * | 2/2002 | Manley et al. | 52/239 |
| 6,517,056 | B2 * | 2/2003 | Shepherd | 256/24 |
| 6,551,429 | B1 * | 4/2003 | McAlpine | 156/157 |
| 6,622,434 | B1 * | 9/2003 | Garrett | 52/6 |
| 6,688,056 | B2 * | 2/2004 | Von Hoyningen Huene et al. | 52/243.1 |
| 6,761,004 | B2 * | 7/2004 | Anglin et al. | 52/238.1 |
| 7,036,280 | B2 * | 5/2006 | Hogan | 52/235 |
| 7,077,756 | B2 * | 7/2006 | Martin et al. | 472/92 |
| 7,090,226 | B1 * | 8/2006 | Trainor et al. | 277/630 |
| 7,150,127 | B2 * | 12/2006 | Underwood et al. | 52/36.1 |
| 2003/0024182 | A1 * | 2/2003 | Yeany | 52/204.67 |
| 2006/0284154 | A1 * | 12/2006 | Sprague | 256/59 |

* cited by examiner

*Primary Examiner*—Brian Glessner
*Assistant Examiner*—James J Buckle, Jr.
(74) *Attorney, Agent, or Firm*—Michael J. Tavella

(57) ABSTRACT

A glass rail design in which the glass infill panels extend vertically beyond the top rail. To achieve this, a new vertical post system has to be created. These vertical posts hold the glass panels in front of the posts. To do this, each post has an extruded form extending forward of the post. The glass panels fit into the extruded form. The top rail is attached to the top of the posts and then runs behind the glass panels. The tops of the panels are covered with a protective cap.

17 Claims, 6 Drawing Sheets

VERTICAL PANEL GLASS WALL

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to vertical panel glass walls and particularly to vertical panel glass walls in which the glass infill panels extend beyond the top rail.

2. Description of the Prior Art

Glass panels have been used to form decorative and functional barriers and railings for some time. Typically, these railing systems have a number of glass panels that are supported by some type of frame structure. The frame structure usually consists of a base shoe that receives the glass panels, a number of vertical support posts, between which, the glass panels are placed, and a top rail, which is placed above the panels.

Railings built in this manner present an aesthetically pleasing structure that is also functional.

BRIEF DESCRIPTION OF THE INVENTION

The instant invention is a significant modification of the traditional rail design. In this design, the glass infill panels extend vertically beyond the top rail. To achieve this, a new vertical post system has to be created. These vertical posts hold the glass panels in front of the posts. To do this, each post has an extruded channel extending forward of the post. The glass panels fit into the extruded form. The top rail is attached to the top of the posts and then runs behind the glass panels. The tops of the panels are covered with a protective cap.

DETAILED DESCRIPTION OF THE INVENTION

Figure 1:
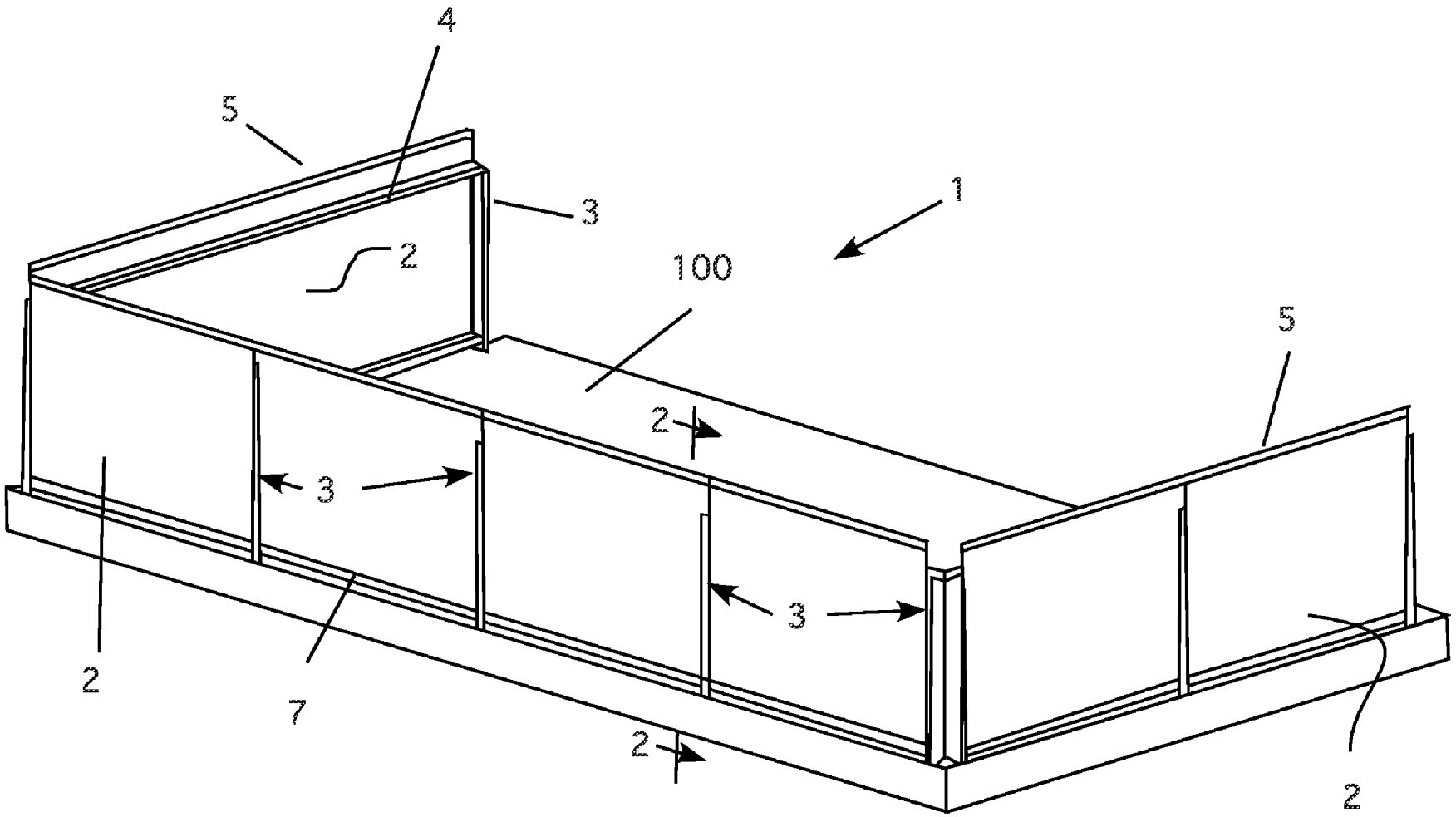
FIG. 1 is a perspective view of my new railing system.

Referring now to FIG. 1, a perspective view of my new railing system 1 is shown. The railing system is installed on a flooring surface 100 (typically concrete or a similar type material). The railing 1 has a number of glass panels 2 that are supported by a number of post assemblies 3. The post assemblies have a top rail 4 that mounts to the tops of the posts. The top rail 4 is positioned behind the glass panel, as shown in the left side of FIG. 1. Note that the top of the glass panel 2 extends above the top rail. A protective cap 5 is placed on the top of each panel to protect the glass. A bottom rail 7 runs along the bottom of the posts, as discussed below. The bottom rail is used to support the glass.

Figure 2:
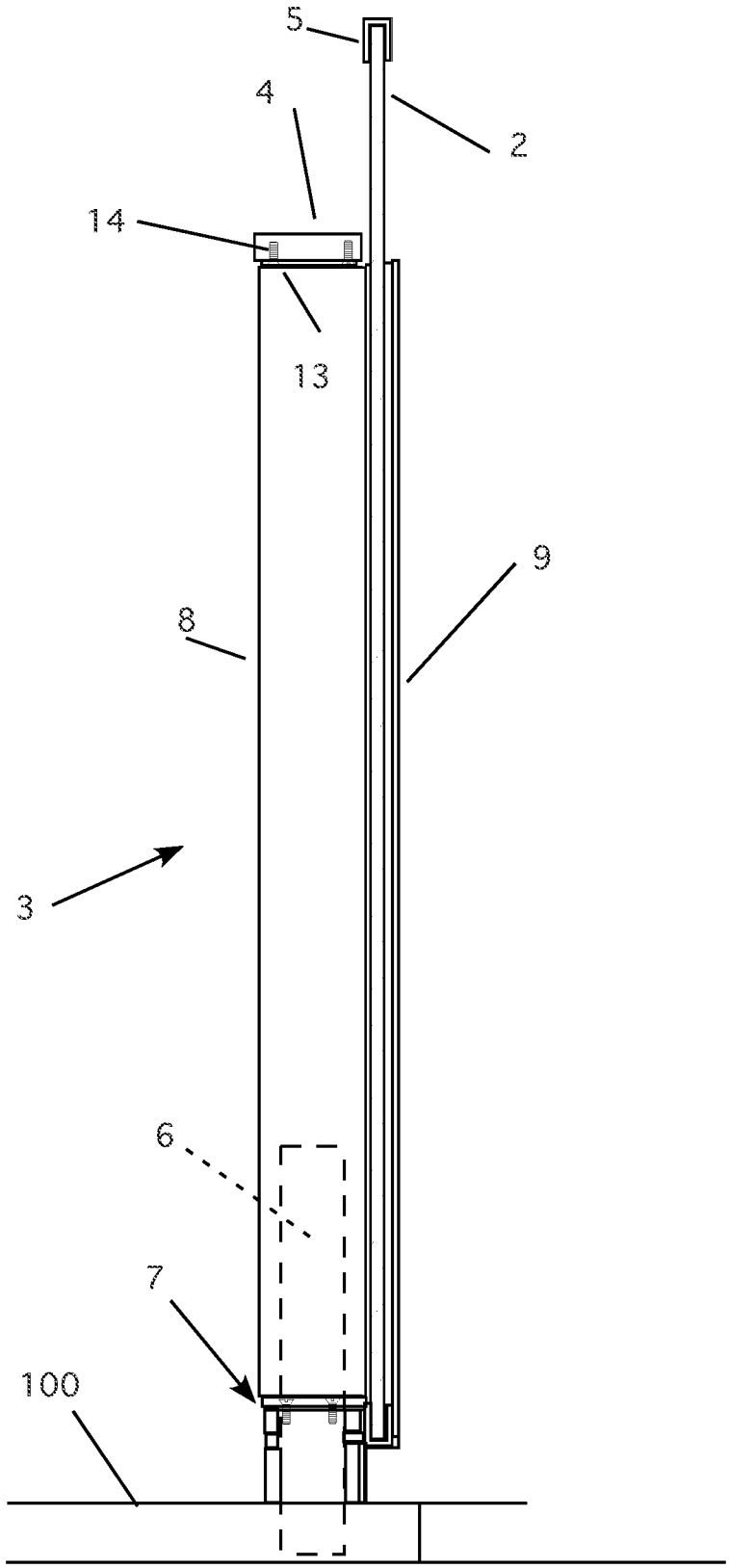
FIG. 2 is a cross-sectional view of a post taken along the lines 2-2 of FIG. 1.

FIG. 2 is a cross-sectional view of a post taken along the lines 2-2 of FIG. 1. Here, the post assembly 3 is shown. Each post is secured to the floor 100 using a stanchion 6, which is typically partially embedded in a concrete floor. The upper portion of the stanchion 6 forms part of the base assembly 7. The post 8 attaches to the base assembly, as discussed below. The post is an extruded member that has a unique, "H" shaped front profile channel 9. See, FIGS. 3,4, and 5. The glass panels sit in the front profile channel 9. As shown in FIG. 2, the glass extends up past the top of the post. The top rail 4, which is secured to a connection plate 13, by bolts 14 or other common fasteners. The protective glass cap 5 is also shown.

Figure 3:
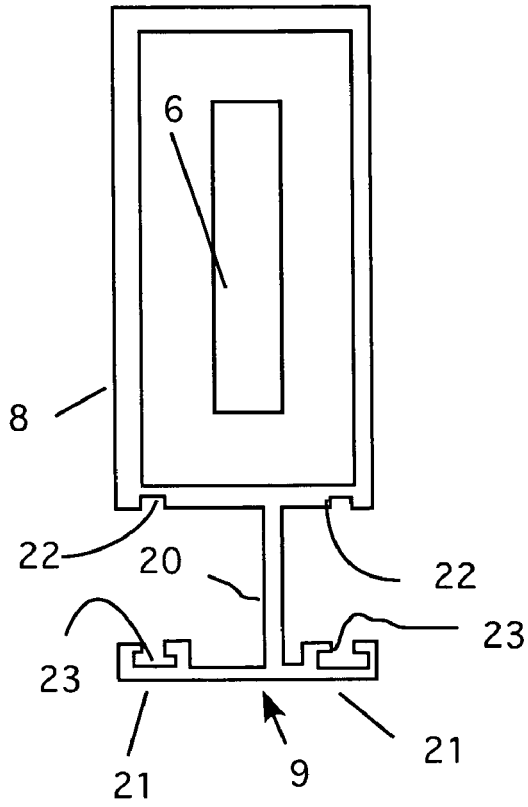
FIG. 3 is a top view of a typical post, without the top rail.

FIG. 3 is a top view of a post, without the top rail. Here, the stanchion 6 is shown in the interior of the post. The post has a generally rectangular shape, as shown. Of course, this shape can be modified to any basic shape that can support the panels of glass as part of the railing and that is aesthetically pleasing. The key to the design is the unique front profile channel 9. The front profile channel 9 has a center divider 20 that extends forward from the main post 4. Two panel holders 21 extend orthogonally from the distal end of the center divider as shown. The front of the post 4 has a pair of grooves 22 formed as shown. The panel holders 21 have a channel 23 formed in them as well. The channels and grooves are used to receive glass vinyl pieces 25 (see FIG. 4).

Figure 4:
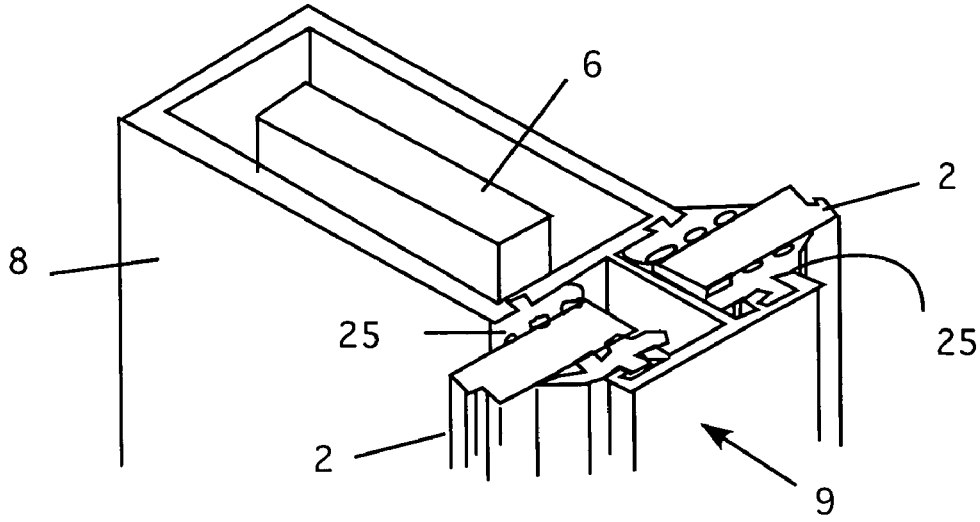
FIG. 4 is a perspective view of a typical post, without the top rail showing the glass in place.

FIG. 4 is a perspective view of a typical post, without the top rail, showing the glass in place. In this view, the glass panels 2 are shown being held by the glass vinyl pieces 25.

Figure 5:
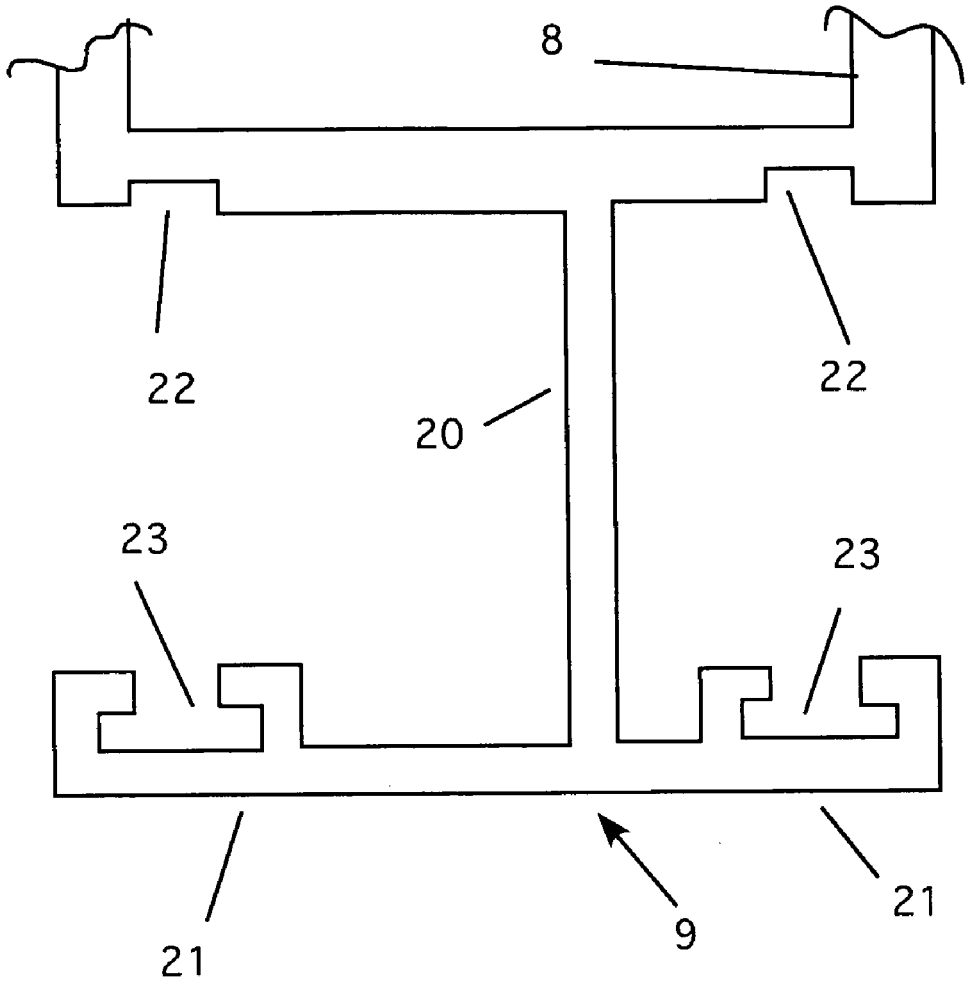
FIG. 5 is an enlarged view of the extruded glass holding member.

FIG. 5 is an enlarged view of the extruded glass holding member that shows the channels 23 and grooves 22 more clearly. This figure also shows the placement of a post close-off insert 26, which is shown in FIG. 6.

Figure 6:
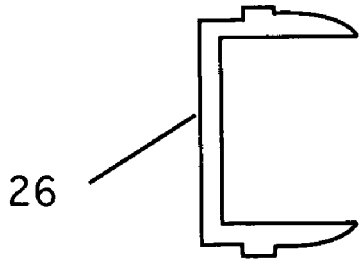
FIG. 6 is a top view of a post close-off insert for the end of the rail.

FIG. 6 is a top view of a post close-off insert 26 for the end of the run. This member is placed in the channel 23 and groove 22 of the last post. Because there is no glass panel in that position, the open space is filled with the post close-off insert 26. See, FIG. 5.

Figure 7:
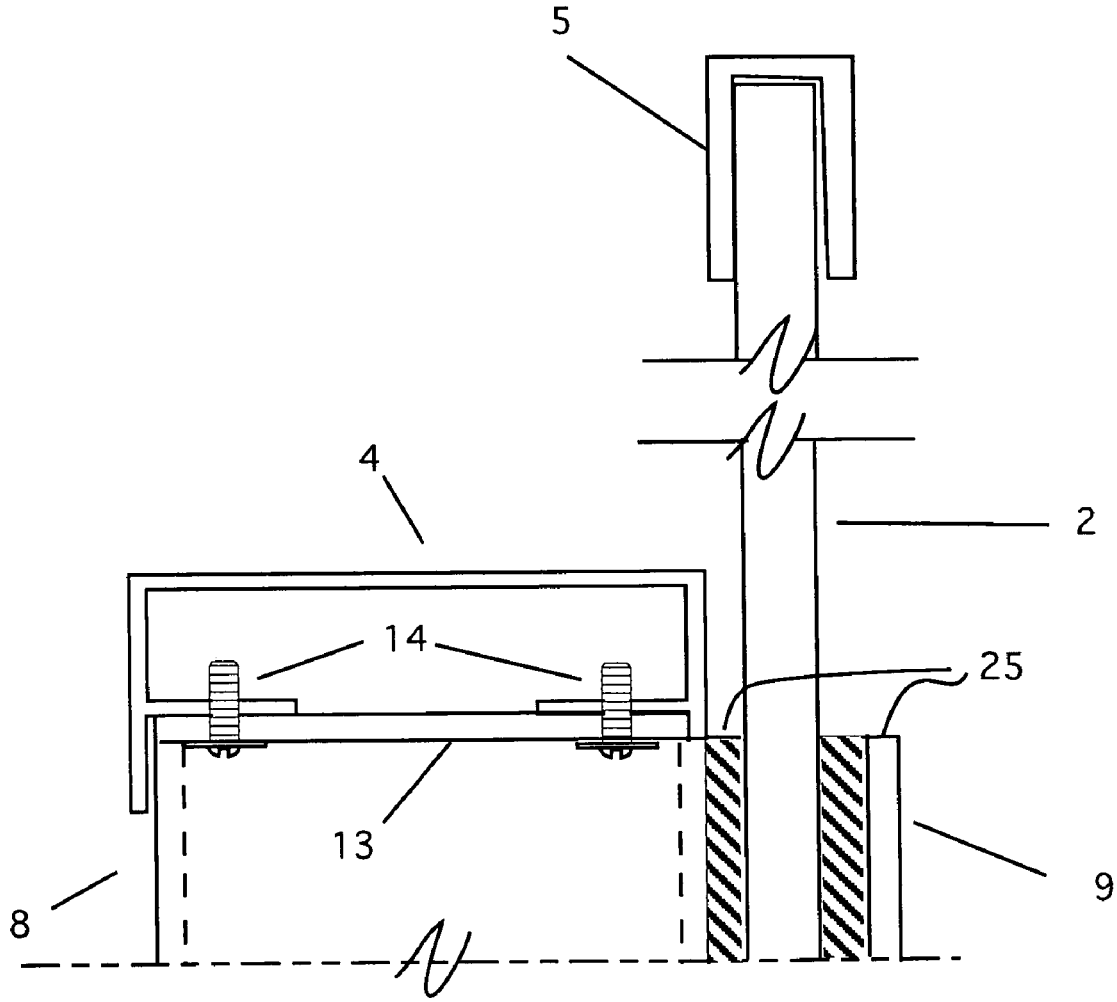
FIG. 7 is a detail view of a post, showing the top rail connection.

FIG. 7 is a detail view of a post, showing the top rail connection. In this view, the glass panel 2 is shown in place within the channel 9. The glass is secured in the post channel 9 with the glass vinyls 25 as discussed above. The protective glass cap 5 is also shown. This figure shows the top rail 4 the rail is secured to a connector plate 13 by screws 14. This assembly is then welded to the post 8 in the preferred embodiment. Of course, other connection means well known in the art can be used as well.

Figure 8:
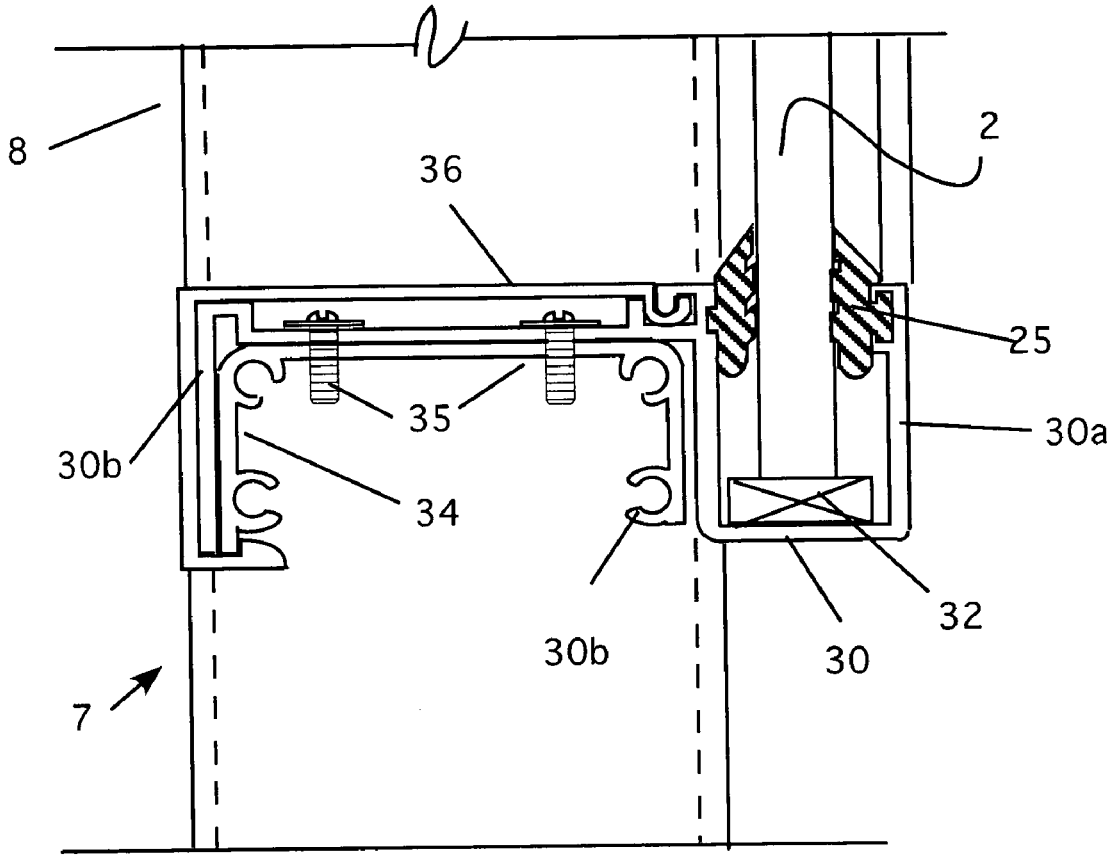
FIG. 8 is a detail view of the post showing the bottom of the post connections.

FIG. 8 is a detail view of the post showing the base assembly 7 and the lower portion of the post. The base assembly 7 includes a bottom channel 30. The bottom channel 30 has a vertical extension 30*a* into which the glass panel is set. This figure shows a glass vinyl 25 in place. The glass is positioned on a glass set block 32. The bottom channel is connected to an extension 30*b* that runs along the bottom of the extruded posts. The base assembly 7 is connected to the posts using a connecting block 34 and screws 35. A snap on cover 36 is provided to allow access to the screws.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A glass railing system using a plurality of vertical glass panels having two side edges, comprising:

a) a plurality of vertical support posts, each of said plurality of support posts having a front, a back a top and a bottom and two sides;

b) a base track, fixedly attached between the sides of each of two of said plurality of vertical support posts, said base track having a means for receiving a glass panel formed therein extending forwardly therefrom, said base track being elevated above the bottoms of each of said plurality of vertical support posts;

c) a means for holding at least one of said side edges of a vertical glass panel formed on the front of each of said plurality of vertical support posts, and d) a top rail, having a top, attached to the top of each of said plurality of posts, such that the top of said top rail is positioned substantially below and behind, the top of said plurality of vertical glass panels.

2. The glass railing system of claim 1 wherein each of said plurality of glass panels has a top, said glass railing system further comprising a protective cover, attached to the top of each of said plurality of glass panels.

3. The glass railing system of claim 1 wherein the means for holding at least one of said side edges of a vertical glass panel includes a length of glass vinyl.

4. The glass railing system of claim 1 wherein each of said plurality of glass panels is secured within the means for receiving a glass panel in said base track.

5. The glass railing system of claim 1 wherein each of said plurality of vertical support posts is attached to a vertical stanchion.

6. The glass railing system of claim 5 wherein each of said vertical stanchions is fixedly attached to a floor.

7. A glass railing system having a plurality of vertical glass panels comprising:

a) a plurality of vertical support posts, each of said plurality of support posts having a front, a back a top, a bottom two sides and a length;

b) a base track, fixedly attached between the sides of each of two of said plurality of vertical support posts, said base track having a front projection, said front projection having a groove for receiving a glass panel formed therein, said base track being elevated above the bottoms of each of said plurality of vertical support posts;

c) an "H" channel, formed on the front of each of said plurality of vertical support posts, said "H" channel lying in a vertical configuration, and having a pair of grooves therein sized to receive an end of a glass panel; and d) a top rail, having a top, attached to the top of each of said plurality of posts, behind said "H" channel, and further such that the top of the top rail is positioned substantially below the top of said plurality of vertical glass panels.

8. The glass railing system of claim 7 wherein each of said plurality of glass panels has a top and, glass railing system further comprising a protective cover, attached to the top of each of said plurality of glass panels.

9. The glass railing system of claim 7 wherein one of said plurality of glass panels is secured in each said "H" channel with a length of glass vinyl.

10. The glass railing system of claim 7 wherein each of said plurality of glass panels is secured within the groove in said front projection of said base track.

11. The glass railing system of claim 7 wherein each "H" channel includes:

a) a center member, extending perpendicularly and outwardly from each of said vertical support posts; and b) a front member, attached to said center member such that said front member is oriented perpendicular to said center member and parallel to said vertical support post.

12. The glass railing system of claim 11 wherein each front member has a length equal to the length of the vertical support post.

13. The glass railing system of claim 11 wherein each "H" channel further includes:

a) a first pair of grooves, formed in the front of each of said vertical support post, and b) a second pair of grooves formed in said front member.

14. The glass railing system of claim 13 wherein said first pair of grooves and said second pair of grooves are in substantial alignment.

15. The glass railing system of claim 14 wherein the first pair of grooves and the second pair of grooves are configured to receive a pair of glass vinyl strips.

16. The glass railing system of claim 7 wherein each plurality of vertical support posts is attached to a vertical stanchion.

17. The glass railing system of claim 16 wherein each of said vertical stanchions is fixedly attached to a floor.

* * * * *